US005402039A

United States Patent [19]

Wolfe

[11] Patent Number: 5,402,039

[45] Date of Patent: Mar. 28, 1995

[54] NON-AUTOMATIC RESETTING THERMAL-PROTECTED BALLAST

[75] Inventor: Denis G. Wolfe, Diablo, Calif.

[73] Assignee: USI Lighting, Inc., San Leandro, Calif.

[21] Appl. No.: 111,112

[22] Filed: Aug. 24, 1993

[51] Int. Cl.[6] ..... H01J 7/24

[52] U.S. Cl. ..... 315/119; 315/362; 315/309; 361/54; 361/55; 361/103

[58] Field of Search ..... 315/291, 309, 362, 119; 361/54, 55, 57, 103

[56] References Cited

U.S. PATENT DOCUMENTS 3,675,081 7/1972 Earing ..... 317/15
3,921,032 11/1975 Hallay ..... 315/106
4,118,683 10/1978 Schwarz ..... 337/91
4,268,813 5/1981 Burch ..... 337/118
4,649,320 3/1987 Hough et al. ..... 315/100
4,740,861 4/1988 Droho et al. ..... 361/105
4,963,797 10/1990 Kulka et al. ..... 315/309
5,023,744 6/1991 Hofsäss ..... 361/26
5,153,484 10/1992 El-Hamamsy ..... 315/248

*Primary Examiner*—Robert J. Pascal
*Assistant Examiner*—Reginald A. Ratliff
*Attorney, Agent, or Firm*—Thomas E. Schatzel

[57] ABSTRACT

An embodiment of the present invention is a ballast for a high intensity discharge lamp that includes a non-automatically resetting thermal protector thermally coupled to a coil wound on a core and insulation between the coil and the core. Only one cycle is allowed into what may be a range of temperatures capable of destroying the insulation within the ballast.

3 Claims, 1 Drawing Sheet

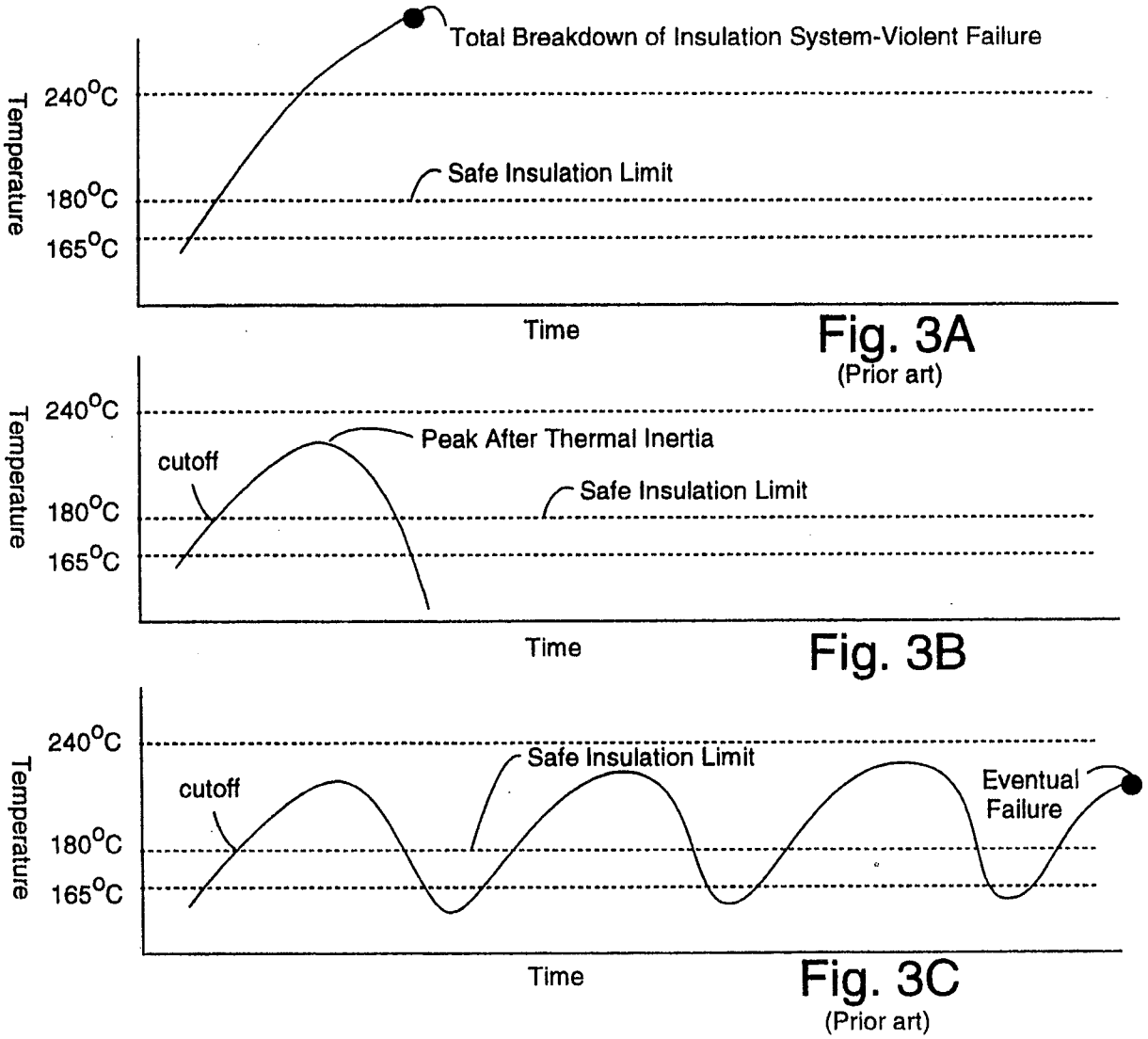
Fig. 3A (Prior art)
Fig. 3B
Fig. 3C (Prior art)
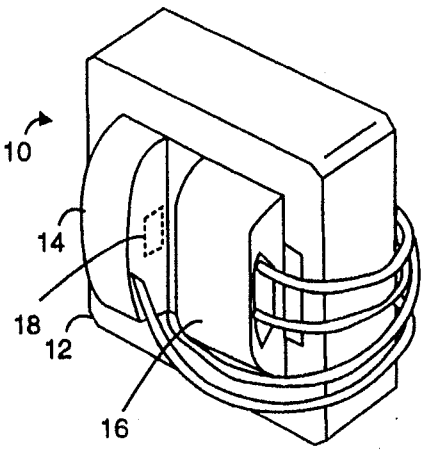
Fig. 1
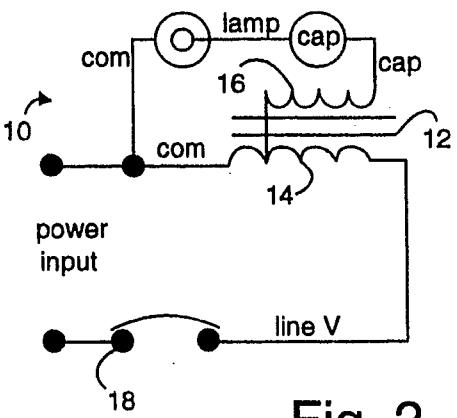
Fig. 2

NON-AUTOMATIC RESETTING THERMAL-PROTECTED BALLAST

BACKGROUND OF THE INVENTION

1. Field of the Invention

The present invention relates generally to high intensity discharge (HID) lamps, and more specifically to HID ballasts.

2. Description of the Prior Art

Ordinary incandescent lamps increase their resistance as their filaments approach operating temperature and are thereby current self-limiting for a given applied voltage. Gaseous discharge lamps, however, draw little current until they ignite and then show a negative resistance characteristic which requires external control. High intensity discharge (HID) lamps are powered by magnetic inductive devices, e.g., ballasts, that control the applied voltage and current.

Some conventional ballasts use "open core and coil" construction, in which a laminated steel or iron core has windings of exposed coils of wire. Typically, these open core and coil ballasts are used in outdoor and non-recessed ceiling applications, so thermal protection is not generally required. Where thermal protection is needed, automatic-reset thermal protection is provided, such as for the very largest ballast of a thousand watts.

Plastics and other insulators are used in open core and coil ballasts to electrically separate the conductor coils from the magnetic core. Typical insulations are rated for a maximum operating temperature of 180° C. Transformers can also be constructed in open core and coil format, and their insulation systems range in maximum operating temperature from 90° C. to 180° C.

HID ballasts are also conventionally manufactured and marketed in encapsulated formats with automatically resettable thermal protection. These ballasts are mainly used for indoor recessed fixture applications, which requires automatically resettable thermal protection. The maximum operating temperature of ballasts using such encapsulants and insulation systems typically ranges between 90° C. and 105° C.

Core and coil ballasts can express certain rare modes of failure where the coils heat up very rapidly due to excessive currents. This can be caused by winding-to-winding shorts, excessive applied voltages, or other faults. Conventional automatically-resettable thermal protection, if built into a ballast, has not proved effective because the coils can rise to destructive temperatures before the automatically resettable thermal protectors can react. A thermal gradient develops between the source of heat and the detector that injects a reaction delay.

The prior art therefore allows destructive operating temperatures to be revisited many times because the system will automatically reset once the protection circuit has removed power and the system has had time to cool. While one such visit may not result in a catastrophic failure, many such cycles can almost be guaranteed to induce a failure which can either be benign or violent in nature. The violent failures must be avoided because they can cause serious personal injury or property damage, and can occur randomly without warning.

Simply lowering the trip temperature of automatic-reset thermal ballast protectors does not address the problem, because the trip temperature would have to be lowered into the normal operating temperature range of a ballast. Nuisance tripping would therefore occur. For example, an open core and coil ballast with a 180° C. insulation system can be safely operated with internal temperatures that approach 165° C. Such an insulation system will begin to rapidly degrade if temperatures are allowed to exceed 180° C.

Ideally, a non-resettable thermal protector could be set to trip at 180° C. A resettable thermal protector commonly needs a setting as low as 120° C. to anticipate rapid temperature rises so that power can be interrupted before temperatures exceeding 180° C. can be experienced. Therefore, a substantial down rating of power levels for open core and coil ballasts, and also transformers, would be required to use resettable thermal protection effectively, thus causing significantly larger and more costly implementations.

Non-resettable types of thermal protectors, based on melting wax or other materials, have been used in transformers, which are similar in character to ballasts. Such melting-material thermal protectors have proven to degrade over time when operated too near their trip temperatures. Failures are common at safe high operating temperatures because a downward shift occurs from the initial temperature trip-point.

SUMMARY OF THE PRESENT INVENTION

It is therefore an object of the present invention to provide a thermally protected open core and coil ballast that is smaller and less expensive for a given power rating and that can be implemented with conventional thermal protection technology.

It is another object of the present invention to provide a ballast that effectively limits operating temperatures and prevents catastrophic temperatures and consequential failures in lighting systems.

Briefly, an embodiment of the present invention is a ballast for a high intensity discharge lamp that includes a non-automatically resetting thermal protector thermally coupled to a coil wound on a core and insulation between the coil and the core. Only one cycle is allowed into what may be a range of temperatures capable of destroying the insulation within the ballast.

An advantage of the present invention is that it provides a lighting system ballast that is smaller and less expensive for a given power rating.

A further advantage of the present invention is that it provides a ballast with effective over-temperature shutdown.

Another advantage of the present invention is that it provides a ballast that permits only one cycle into destructive operating temperature range.

These and other objects and advantages of the present invention will no doubt become obvious to those of ordinary skill in the art after having read the following detailed description of the preferred embodiments which are illustrated in the various drawing figures.

IN THE DRAWINGS

FIG. 1 is a perspective view of an open core and core ballast of the present invention;

FIG. 2 is a schematic diagram of lighting system that includes the ballast of FIG. 1;.

FIG. 3A is a graph of temperature versus time for a prior art non-protected short term fault that ends in a total breakdown of the insulation system and a violent failure;

FIG. 3B is a graph of temperature versus time for a non-automatically resettable thermal protected ballast of the present invention which rises to a peak due to thermal inertia after a power cutoff at 180° C. and then returns within the safe insulation limit of 180° C.; and FIG. 3C is a graph of temperature versus time for a prior art automatically-reset thermal protector that allows repeated cycles that exceed the safe insulation limit of 180° C. and ends in an eventual failure of the ballast its designed to protect.

DETAILED DESCRIPTION OF THE PREFERRED EMBODIMENTS

FIG. 1 illustrates a high intensity discharge (HID) lamp ballast embodiment of the present invention, referred to by the general reference numeral 10. FIG. 2 illustrates ballast 10 in an exemplary HID lighting system. Ballast 10 comprises a core 12, a pair of winding coils 14 and 16, and a non-automatically resetting thermal protection device 18. Preferably, device 18 includes a bi-metallic switch that open-circuits at 180° C. and stays open once the temperature returns to below 165° C.

The present invention includes a non-automatically resettable thermal protector. Only one cycle into destructive temperatures is permitted by the protector. For example, FIG. 3A graphs the temperature versus time for a prior art non-protected short term fault that ends in a total breakdown of the insulation-system and a violent failure. FIG. 3B graphs the temperature versus time for the non-automatically resettable thermal protected ballast 10. Operating temperatures can rise once to a peak due to thermal inertia after a power cutoff at 180° C. and then return within the safe insulation limit of 180° C. FIG. 3C graphs the temperature versus time for a prior art automatically-reset thermal protector that allows repeated cycles that exceed the safe insulation limit of 180° C. and ends in an eventual failure of the ballast its designed to protect. Ballast 10 does not allow such repeated events to occur automatically.

Thermal protector 18 may either be physically wound into ballast coil 14 or 16, or externally applied to a coil to interrupt the incoming line voltage, as shown schematically in FIG. 2. Preferably, such thermal protection exhibits a temperature-stable trip-point, even when operated for extended periods at normal ballast operating temperatures. The tripping temperature may then be chosen to be very near the destructive temperature zone, to eliminate nuisance interruptions. A bi-metallic switch, for example, has the required inherent long-term thermal stability.

The present inventor has tested internal current fuses in place of protector 18 to see if such a device is effective in quickly shutting down an overheated coil. An internal current fuse wound into coil 14 or 16 would respond to both current and heat. Current fuses characteristically derate when the operating temperature is increased. Such fuses have been commercially available in a limited number of ballasts, but have proven to be difficult to apply in multi-top ballasts where the proper current setting depends on which tap is used. Testing by the present inventor indicates that the temperature sensitivity of the current fuse is not significant until temperatures of 240° C. are encountered, therefore such a device is not effective in a non-automatically resettable thermal protector.

Tests continue to indicate that using a non-automatically resettable thermal protector of the bi-metallic type is the most appropriate approach.

Although the present invention has been described in terms of the presently preferred embodiments, it is to be understood that the disclosure is not to be interpreted as limiting. Various alterations and modifications will no doubt become apparent to those skilled in the art after having read the above disclosure. Accordingly, it is intended that the appended claims be interpreted as covering all alterations and modifications as fall within the true spirit and scope of the invention.

What is claimed is:

1. A high intensity discharge (HID) lamp ballast, comprising:

a ballast core with an insulation material having a normal operating temperature maximum and a higher safe insulation limit temperature;

a ballast coil wound on the ballast core;

a non-automatically resettable thermally-operated switch thermally connected to the ballast coil and electrically connected in series with the ballast coil for providing an interruption of power once said safe insulation limit temperature is exceeded;

temperature sensing means connected to the non-automatically resettable thermally-operated switch such that once said safe insulation limit temperature is exceeded the non-automatically resettable thermally-operated switch is permanently prevented from re-closing;

wherein a destructive operating temperature of said ballast is permitted to occur only once.

2. The ballast of claim 1, wherein:

the non-automatically resettable thermally-operated switch and temperature sensing means include a bimetallic switch operable at said safe insulation limit temperature.

3. A method of thermally protecting a high intensity discharge (HID) lamp, comprising the steps of:

monitoring an operating temperature of a ballast that provides a connection to a HID lamp and that has insulation with a maximum operating temperature and a higher safe insulation limit temperature;

switching off power to said ballast when said operating temperature is greater than said maximum safe operating temperature and less than said higher safe insulation limit temperature; and permanently holding-off power to said ballast wherein subsequent excursions of ballast temperature above said safe operating temperature are avoided.

* * * * *